United States Patent [19]

Tuckey

[11] Patent Number: 5,013,221

[45] Date of Patent: May 7, 1991

[54] ROTARY FUEL PUMP WITH PULSE MODULATION

[75] Inventor: Charles H. Tuckey, Cass City, Mich.

[73] Assignee: Walbro Corporation, Cass City, Mich.

[21] Appl. No.: 572,669

[22] Filed: Aug. 27, 1990

Related U.S. Application Data

[62] Division of Ser. No. 533,899, Jun. 6, 1990.

[51] Int. Cl.[5] ..... F04B 35/00

[52] U.S. Cl. ..... 417/365; 417/312; 417/423.7; 417/423.12; 310/191

[58] Field of Search ..... 417/365, 366, 410, 423.7, 417/423.12, 423.13; 310/191

[56] References Cited

U.S. PATENT DOCUMENTS

| | | | |
|---|---|---|---|
| 2,824,520 | 2/1958 | Bartels | 417/423.7 |
| 3,836,291 | 9/1974 | Bottcher et al. | 417/423.7 |
| 4,218,196 | 8/1980 | Ohnishi | 417/366 |
| 4,447,192 | 5/1984 | Tuckey | 417/410 |
| 4,569,638 | 2/1986 | Marker et al. | 417/365 |
| 4,624,630 | 11/1986 | Hirahara et al. | 310/191 |
| 4,662,827 | 5/1987 | Wiernicki | 417/366 |

*Primary Examiner*—Michael Koczo
*Assistant Examiner*—M. Kocharov
*Attorney, Agent, or Firm*—Barnes, Kisselle, Raisch, Choate, Whittemore & Hulbert

[57] ABSTRACT

A rotary pump for pumping fuel for internal combustion engines in the form of a vane pump or gear and rotor pump with pumping chambers disposed circumferentially around the rotor. The chambers progressively increase in the inlet area of the pump to draw in fuel and progressively ensmall at the outlet area to discharge fuel under pressure to supply an engine. The pulsations initiated in the pump are absorbed in the pump by a closed chamber exposed to the pump outlet flow, the chamber having flexible walls and an internal pressure above atmospheric to reduce pulses in the outlet and resulting pump noise. The chamber is blow molded with an enclosed volume surrounded by flexible walls.

10 Claims, 1 Drawing Sheet

ROTARY FUEL PUMP WITH PULSE MODULATION

This application is a division of application Ser. No. 533,899 filed June 6, 1990.

FIELD OF INVENTION

Electric fuel pumps utilizing a rotary pump and electric drive housed together for mounting of a vehicle or in a vehicle fuel tank.

BACKGROUND AND FEATURES OF THE INVENTION

Rotary fuel pumps driven by an electrical powering device have been utilized for some years in some vehicles either as original equipment or as appliances to supplement the original fuel supply system. The pump and power unit are frequently in a common housing as shown, for example, in U.S. Pat. No. 4,401,416, issued Aug. 30, 1982 to Charles H. Tuckey.

Since the pumps are frequently mounted in the fuel tanks of a vehicle, the noise factor is extremely important. A pump under load will normally produce more noise and this may be audible as a humming noise, to an annoying degree, to passengers in the vehicle.

It will be appreciated that in the pumping cycle, as one pumping cell is exhausting, another cell is taking in fluid at the same time. In other words, intake and exhaust pressure waves are timed with one another, and normally the quantity of fluid being exhausted from each cell is the same as that being taken in by another cell.

It is an inherent characteristic of a positive displacement pump to produce slight pressure pulses each time one of the multiple vanes passes through its pumping cycle. For example, a roller vane rotary pump produces an audible humming noise when operating at system pressure. This noise has a tendency to increase as the output pressure requirement is increased.

It has been a desire of manufacturers and users of positive displacement rotary pumps to reduce or eliminate pressure pulses in order to achieve a smooth, pulse-free flow of fluid out of a pump at desired operating pressure.

An object of the present invention is to allow the exhaust pressure peaks to counter the negative inlet pressure valleys thereby cancelling one another and attaining a smooth flow in and out of the assembly and at the same time reducing the pump noise.

This concept involves the utilization of a resilient member between the inlet and exhaust zones within the pump assembly. Thus, each time a pressure peak occurs in the exhaust fluid, the pressure can force the resilient member to yield or move toward the inlet fluid, thereby simultaneously off-setting the negative pressure which occurred at the same time on the inlet side.

It has been noted that pressure waves or pulses are preset at the inlet, as well as the outlet, at all operating pressures.

One must acknowledge and deal with the extreme pressure differential between the inlet and exhaust sides of the pump. For instance, the inlet zone is usually at an average pressure close to atmospheric; and the outlet zone average pressure is much higher, i.e., 60 psi or more depending upon the operating pressure requirement of the pump.

Hollow pulse absorbing chambers in fuel pumps have been proposed previously as exemplified in U.S. Pat. No. 4,181,473 to Yoshifumi issued Jan. 1, 1980 and U.S. Pat. No. 4,521,164 to Tuckey issued June 4, 1985.

In the present invention a hollow pulse modulator of a flexible plastic material is proposed formed by a blow molding process in which the internal pressure within the walls of the hollow chamber is above atmospheric and introduced into the chamber during the molding process.

Other objects of the invention will be apparent in the following description and claims in which the invention is described, together with details to enable a person skilled in the art to practice the invention all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
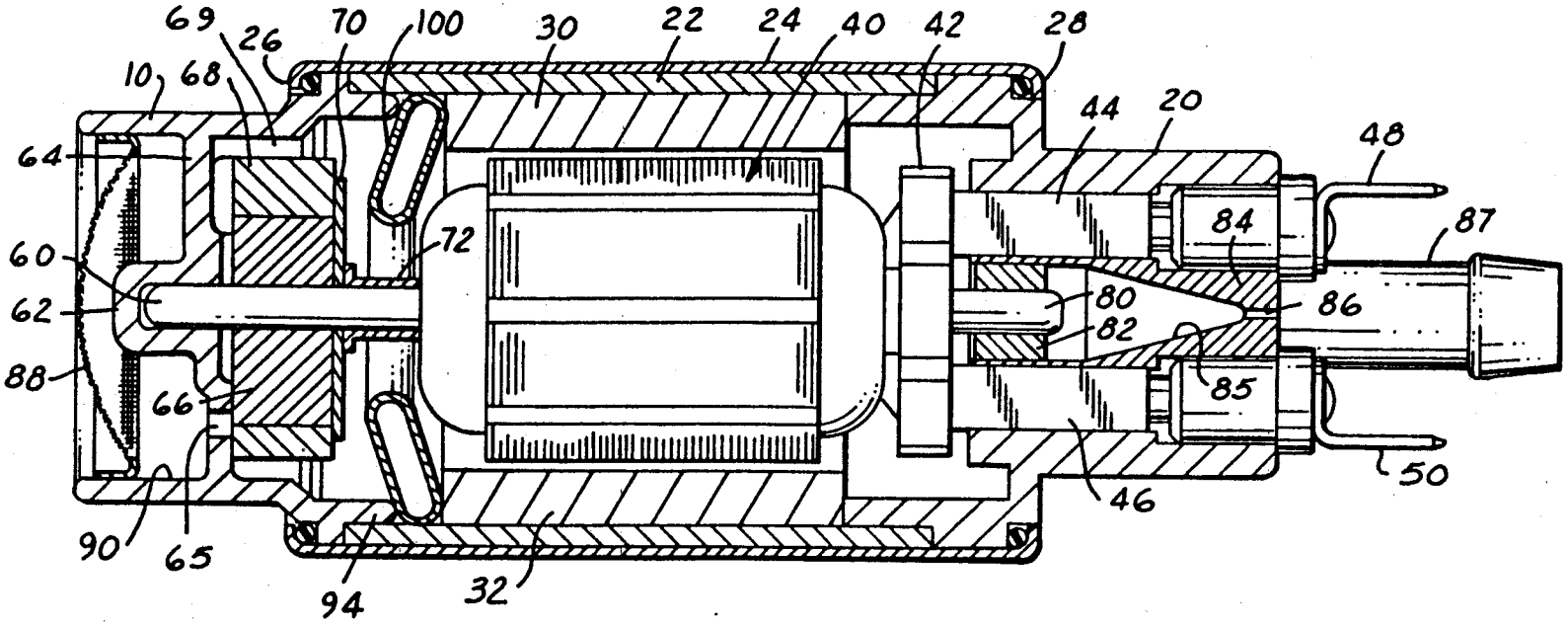
FIG. 1, a sectional view of an electric fuel pump incorporating a pulse dampener.
Figure 2:
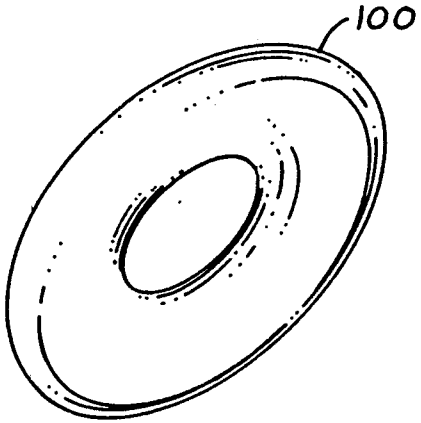
FIG. 2, a perspective view of pulse dampeners formed as a blow-molded product.

With reference to the drawings, in FIG. 1, a fuel pump is illustrated in a longitudinal section having an inlet housing 10 and an outlet housing 20 separated by a cylindrical field casing 22. An encompassing case cover 24 with O-ring seals at each end has ends 26, 28 spun over to unify the assembly. Armature magnets 30 and 32 are disposed in a conventional way around a rotating armature 40 which has a commutator 42. Brushes 44 and 46 in outlet housing 20 are resiliently pressed against the face of the commutator 42 with suitable electrical connectors 48 and 50.

The armature 40 has a mounting shaft 60 journaled in a boss 62 formed in a wall 64 of the inlet housing 10. An inlet port 65 in the wall admits fuel to the inlet side of the pump which comprises an inner gear rotor 66 pressed on and permanently affixed to the shaft 60 and positioned within an outer gear rotor 68. A pump outlet port 69 is provided but pump outlet fuel may also pass the flexible seal 70 which is free to rotate with the outer gear 68 and is pressed against the rotors by an eyelet 72 mounted between the armature and the seal. The gear teeth on the rotors 66 and 68 are preferably meshed helical gears, as described more fully in my issued U.S. Pat. No. 4,596,519, dated June 24, 1986, to reduce and smooth out pulsations in the pump output.

At the other end of armature 40 a mounting shaft 80 is journaled in a pressed-on bushing 82 in a central insert 84 in the outlet housing 20. The bushing 82 is affixed to the shaft 80 and is axially movable in the insert in a recess 85. A small vent 86 is provided at the end of the recess 85. The bushing 82 rotates with the shaft 80. An outlet nipple connection 87 is provided in a conventional way. A filter screen 88 extends over the basic opening 90 in the inlet housing 10.

The inlet 10 has an inwardly extending flange 94 facing the armature magnets 30, 32. Captured between the inner edge of the flange 94 and the magnets is a hollow pulse dampener 100 shaped as a toroid with an open center and conically formed as illustrated in the drawing. The material from which the toroid is formed is a flexible plastic resistant to hydrocarbons, such as ACETEL TM. The material is formed as a sealed chamber in a blow molding process in which the interior pressure is controlled to above atmospheric, for example, 16 to 40 pounds per square inch. This can be controlled to relate to the capacity of the pump in which it is installed.

The shape of the pulse dampener 100 as a partial cone has significance relative to the life of the element. When the shape lies between two parallel planes in an at rest state, the walls are slightly bulged, because of the internal pressure, but upon exposure to higher pressures, the tendency is to expand in both diametric dimensions. The shape of the device resists this change of dimension. However, with the conical shape, there is a slight change of angle but there is less resistance to the diametrical change and thus there is less stress on the material. This contributes to a longer life of the unit.

The pressurized chamber may also be formed of a thin walled tube by closing one end of the tube and squeezing a length of the tubing between rollers toward the closed end to increase the pressure in the closed end. The tube is then sealed behind the rollers to leave a pressurized segment. This segment may be introduced into the pump chamber as a length or as a toroid.

This interior pressure within the pulse dampener avoids the necessity for a spring bias and provides a calculable increase in resistance as the outer pressure rises. Thus, with the use of helical gears as a pulse reduction and the cooperation of the pressure contained pulse chamber, the vibration and noise of a fast operating pump can be reduced to the point that is practically undetectable.

Another feature of the invention lies in the balancing of axial forces on the armature. The brushes 44, 46 are urged to the left against the commutator plate 42 by the usual backing springs. Pressure in the armature chamber as well as the negative pressure in the inlet chamber 90 also puts forces on the pump rotors to the left. The interface friction of the inner and outer rotors against the wall 64 places a load on the pump in addition to the actual pumping load. This is counteracted by pressure on the movable bushing 82 at the right end of the armature. Also, the armature magnets are shifted to the right a slight amount to create a counterbalancing force to the right. Thus, the normal operating forces to the left, namely, the brush forces and the pressure forces to the left are balanced by the magnetic forces on the armature tending to move the armature to the right. This reduces the friction loads on the pump rotors. This in turn reduces the current drag on the armature and increases the efficiency of the pump.

What is claimed is:

1. In an electrical fuel pump that includes an elongated housing having an inlet and an outlet at axially opposed ends thereof, a d.c. motor including armature means journaled for rotation with said housing between said ends and stator means within said housing surrounding said armature means and magnetically coupled thereto, and pumping means affixed to said armature means and positioned adjacent to said inlet end of said housing for pumping fuel from said inlet through said housing to said outlet and thereby creating a pressure differential across said pumping means tending to urge said pumping means into frictional engagement with said inlet end, the improvement in which said stator means has a greater dimension axially of said housing toward said outlet end than toward said inlet end with respect to said armature means, thereby being effectively offset within said housing toward said outlet and magnetically attracting said armature axially of said housing toward said outlet so as to at least partially counterbalance said pressure differential across said pumping means.

2. The pump set forth in claim 1 wherein said stator means comprises an array of permanent magnets circumferentially surrounding said armature means.

3. The pump set forth in claim 2 wherein said armature means comprises a commutator plate affixed to said armature means, commutator brushes in said outlet end of said housing, and means in said outlet end resiliently urging said brushes against said plate so as to urge said armature means and said pumping means toward said inlet end.

4. The pump set forth in claim 1 wherein said pumping means comprise gerotor pumping means including an outer gear and an inner gear affixed to said armature means.

5. The pump set forth in claim 1 further comprising a bearing affixed to said armature means and slidably journaled in said outlet end such that pressure of fuel on said bearing within said housing at least partially counterbalances said pressure differential across said pumping means.

6. The pump set forth in claim 5 further comprising a recess in said outlet end of said housing, said recess being open at one end within said housing and vented at another end to atmosphere, said bearing being slidably and rotatably journaled within said recess.

7. In an electric fuel pump that includes an elongated housing having an inlet at one end and an outlet at the other end, a d.c. motor including armature means journaled for rotation within said housing and stator means within said housing surrounding said armature and magnetically coupled thereto, and pumping means coupled to said armature and positioned adjacent to one of said inlet and said outlet for pumping fuel through said housing and thereby creating a pressure differential across said pumping means, the improvement for counteracting said pressure differential in which said stator means is offset from said armature means within said housing in a direction toward said outlet such that magnetic attraction between said armature means and stator means at least partially counterbalances said pressure differential.

8. In an electric fuel pump that includes an elongated housing having an inlet and an outlet at axially opposed ends thereof, a d.c. motor including armature means journaled for rotation with said housing between said ends and stator means within said housing surrounding said armature means and magnetically coupled thereto, and pumping means affixed to said armature means and positioned adjacent to said inlet end of said housing for pumping fuel from said inlet through said housing to said outlet and thereby creating a pressure differential across said pumping means tending to urge said pumping means into frictional engagement with said inlet end, the improvement in which said pump further comprises a bearing affixed to said armature means and slidably journaled in said outlet end such that pressure of fuel on said bearing within said housing at least partially counterbalances said pressure differential across said pumping means.

9. The pump set forth in claim 8 further comprising a recess in said outlet end of said housing, said recess being open at one end within said housing and vented at another end to atmosphere, said bearing being slidably and rotatably journaled within said recess.

10. The pump set forth in claim 8 in which said stator means has a greater dimension axially of said housing toward said outlet end than toward said inlet end with respect to said armature means, thereby being effectively offset within said housing toward said outlet and magnetically attracting said armature axially of said housing toward said outlet so as to at least partially counterbalance said pressure differential across said pumping means.

* * * * *